United States Patent [19]

Osaka

[11] 4,236,544

[45] Dec. 2, 1980

[54] SAFETY-ENHANCING WALKING STICK

[76] Inventor: Takeshi Osaka, No. 379-2, Kitairiso, Sayama-shi, Saitama-ken, Japan

[21] Appl. No.: 973,809

[22] Filed: Dec. 28, 1978

[30] Foreign Application Priority Data

Feb. 24, 1978 [JP] Japan ..... 53-19762

[51] Int. Cl.[3] ..... A45B 3/04

[52] U.S. Cl. ..... 135/66; 135/DIG. 10; 135/DIG. 11; 362/102

[58] Field of Search ..... 135/66, DIG. 10, DIG. 11; 362/102

[56] References Cited

U.S. PATENT DOCUMENTS

| | | | |
|---|---|---|---|
| 1,723,780 | 8/1929 | Hayhoe | 135/DIG. 10 |
| 2,878,366 | 3/1959 | Evans | 135/DIG. 10 |
| 4,099,535 | 7/1978 | Hubachek | 135/66 |

FOREIGN PATENT DOCUMENTS

| | | | |
|---|---|---|---|
| 1192810 | 10/1959 | France | 362/102 |
| 1270457 | 4/1972 | United Kingdom | 135/DIG. 11 |

*Primary Examiner*—J. Karl Bell

*Attorney, Agent, or Firm*—Robert E. Burns; Emmanuel J. Lobato; Bruce L. Adams

[57] ABSTRACT

A safety-enhancing walking stick incorporating a light source which produces periodic flashes of high intensity light and is powered by self-contained batteries, the generation of the light flashes being controlled in accordance with the ambient illumination level.

11 Claims, 4 Drawing Figures

SAFETY-ENHANCING WALKING STICK

This invention relates to safety-enhancing walking sticks for blind or aged persons which incorporate a warning light source, and in particular to a safety-enhancing walking stick in which periodic flashes of high-intensity light are produced, and in which the intensity of the light flashes is varied in proportion to the level of ambient illumination.

With the present-day volume of road traffic in all parts of the world, the danger of death or serious injury to blind or elderly persons due to road accidents has become a serious problem. This is particularly true at dusk or after dark, since the traditional white cane or walking stick, which is used by such pedestrians as a type of warning signal to other road users, becomes difficult to see from a road vehicle. Thus, due to the high speeds of present day motor traffic, such blind or elderly pedestrians are in considerable danger of being struck by passing road vehicles. As a method of alleviating this problem, the use of a special type of walking stick having a built-in source of light has been proposed, so that the walking stick can provide a more effective warning to other road users in conditions of low ambient illumination. However, since such a walking stick must necessarily be battery-powered, it is not practicable to achieve a high intensity of light output from the walking stick, due to limitations on the allowable drain on the battery. Thus, for example, if such a walking stick is viewed from a vehicle at the same time that another vehicle's headlights are approaching, the walking stick may be almost invisible. In other words, there will be insufficient contrast between the low-level steady-state light from the walking stick by comparison with the high intensity of the oncoming headlights. Thus, even such a conventional type of safety-enhancing walking stick may provide insufficient protection in some circumstances, and may even lend a false sense of security to the blind or elderly user, which may in itself present a considerable danger.

With a safety-enhancing walking stick in accordance with the present invention, the above disadvantages of the conventional type of such walking sticks are aliminated. A warning signal is generated by means of periodic flashes of high intensity light stick. Once a switch on the walking stick has been actuated, these flashes are produced automatically after the ambient light level falls below a predetermined value. Since the duty cycle of the light flashes is very low, each flash can be of very high intensity without an excessive battery consumption being caused, so that a high degree of contrast is obtained between the warning flashes from the walking stick and the light from vehicle headlights. This ensures that the user of a safety-enhancing walking stick in accordance with the present invention will achieve a very high level of security under almost all road conditions, at any time of the day or night.

It is therefore an object of the present invention to provide an improved type of safety-enhancing walking stick for the use of blind or elderly persons, which produces a clear and distinct warning signal under various ambient lighting conditions.

Other objects, features and advantages of the present invention will be made more apparent from the following description, when taken in conjunction with the attached drawings, whose scope is given by the appended claims.

Figure 1A:
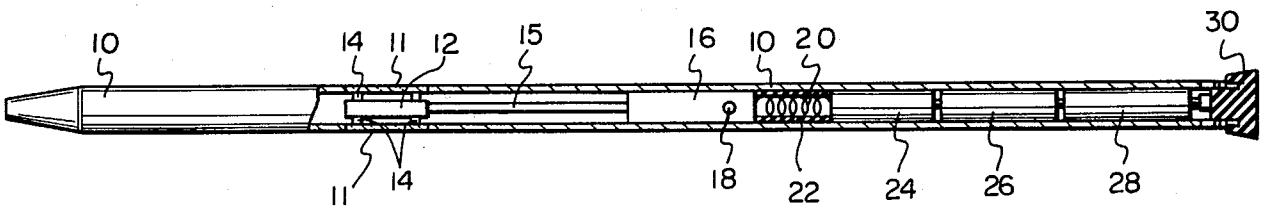
FIG. 1A is a simplified part-cross-sectional view of an embodiment of a safety-enhancing walking stick in accordance with the present invention.

Referring now to the figures, FIG. 1A shows an embodiment of a safety-enhancing walking stick in accordance with the present invention, as viewed in partial longitudinal cross-section. A hollow casing 10 is made of aluminium or aluminium alloy, with the exception of a transparent or translucent portion 11 which is tinted red in color. A xenon flash tube 12 is situated within casing 10 adjacent to the translucent portion 11. Xenon flash tube 12 is flexibly supported within casing 10 by means of supporting pieces 14, made of an elastic type of material such as rubber. The support thus provided to xenon flash tube 12 ensures protection against damage to the tube in the event of the walking stick being struck against a hard object, since the shock thus produced is absorbed by supporting pieces 14.

Xenon flash tube 12 is electrically connected, by means of conductors 15, to an electronic circuit module 16 which drives xenon flash tube 12 periodically to produce flashes of light. A photocell 18 is provided on circuit module 16, and serves to detect the level of ambient light through an opening in casing 10 adjacent to photocell 18. Electronic circuit module 16 periodically supplies energy to xenon flash tube 12 if the level of ambient illumination detected by photocell 18 is below a minimum value.

Electronic circuit module 16 is mechanically fixed within casing 10, and a spring 20 is located between electronic circuit module 16 and three batteries 24, 26 and 28 which are connected in series to supply power to electronic circuit module 16. Spring 20 provides electrical connection between the negative potential end of batteries 24, 26 and 28 and electronic circuit module 16, and is insulated from casing 10 by means of an insulating sleeve 22.

Figure 1B:
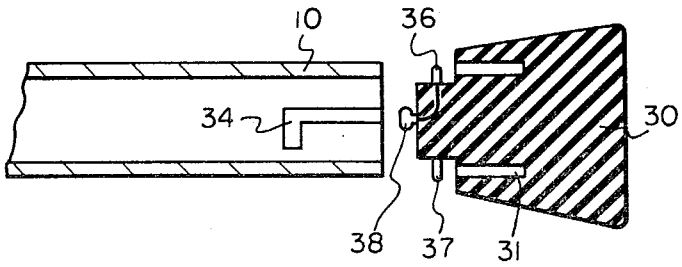
FIG. 1B is a cross-sectional view illustrating a switch portion of the walking stick shown in FIG. 1A.
Figure 1C:
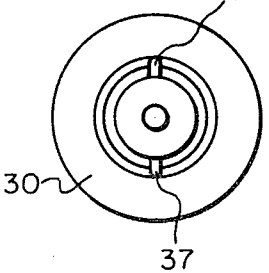
FIG. 1C is a cross-sectional view of the switch portion of FIG. 1A, taken in a plane at right angles to the axis of the walking stick.

A knob 30 is located at one end of the casing 10, and functions as a switch for connecting batteries 24, 26 and 28 to electronic circuit module 16. This switching means is illustrated in FIG. 1B. Knob 30 is made mainly of an insulating material, but also incorporates electrical contacts 36, 37 and 38, which are connected together electrically. Contacts 36 and 37 fit into two corresponding recessed portions of the inner surface of casing 10, the shape of which is indicated by numeral 34. A circular recessed portion 31 is provided in knob 30, into which the end of casing 10 fits, so that knob 30 is frictionally attached to casing 10. In this condition, since the diameter of contacts 36 and 37 is smaller than the width of recessed portions 34 in casing 10, electrical connection between casing 10 and contacts 36 and 37 (and hence contact 38) can be established by rotating knob 30 to a position in which contacts 36 and 37 do not touch casing 10. Similarly, electrical contact between contacts 36 and 37 and casing 10 can be established by rotating knob 30 to a position in which contacts 36 and 37 are touching casing 10.

One supply voltage terminal of electronic circuit module 16 is connected to casing 10, and so can be connected to the positive terminal of series-connected batteries 24, 26 and 28 by rotating knob 30 to an appropriate position. Thus, power can be applied to or disconnected from electronic circuit module 16 by rotating knob 30.

Figure 2:
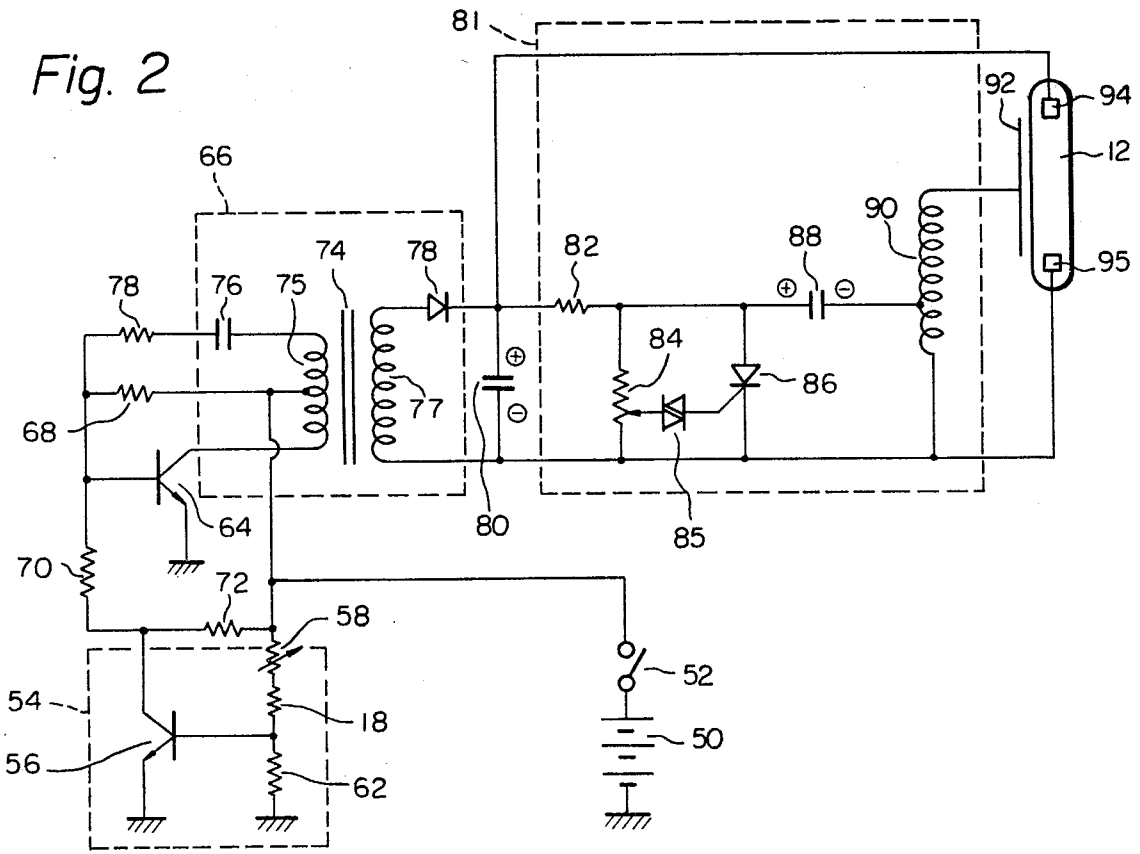
FIG. 2 is a circuit diagram of an electronic circuit module and a flash tube for use in the embodiment of FIG. 1.

Referring now to FIG. 2, a circuit diagram is shown therein of the electronic circuit module 16 and xenon flash tube 12. Numeral 50 collectively denotes series-connected batteries 24, 26 and 28 shown in FIG. 1A. Numeral 52 indicates the switch means constituted by knob 30 and adjacent portions of casing 10, as described above. Numeral 54 denotes a circuit for detecting the level of ambient light, in conjunction with a cadmium sulphide photocell 18. One terminal of photocell 18 is connected to the base of a transistor 56 and to one end of a resistor 62. The other end of resistor 62 is connected to circuit ground, to which the low potential end of battery 50 is also connected. The emitter of transistor 56 is connected to circuit ground. A variable resistor 58 is connected between a terminal of photocell 18 and the high potential of battery 50. A resistor 72 is connected between the collector of transistor 56 and the high potential of battery 50.

Numeral 66 denotes a DC to DC converter, which serves to step up the voltage of battery 52, in conjunction with a transistor 64. The emitter of transistor 64 is grounded, while its base is connected through a resistor 70 to the collector of transistor 56. Numeral 74 denotes a transformer having a center-tapped primary winding 75, the center tap of which is connected to the high potential of battery 52. One end of primary winding 75 is connected to the collector of transistor 64, while the other end is connected through a capacitor 76 and resistor 78 to the base of transistor 64. The center tap of transistor 64 is connected through resistor 68 to the base of transistor 64. One end of secondary winding 77 of transformer 74 is connected to a diode 78, while the other end is connected to one terminal of a capacitor 80, one end of a variable resistor 84, to a terminal of a silicon controlled rectifier 86 (designated hereinafter as SCR), one end of a voltage step-up coil 90 and an electrode of xenon flash tube 12. The other terminal of diode 78 is connected to the other terminal of capacitor 80, to one end of a resistor 82, and to another terminal 94 of xenon flash tube 12. The other ends of resistors 82 and 84 are connected together and to another terminal of SCR 86, as well as to one terminal of a capacitor 88. The other terminal of capacitor 88 is connected to a tap on voltage step-up coil 90. The remaining end of voltage step-up coil 90 is connected to an electrode 92, which is used to trigger a discharge between electrodes 94 and 95 of xenon flash tube 12.

The operation of this circuit will now be described.

We shall first assume that the level of ambient light is sufficiently high that a warning flashing signal is not necessary. This high level of light, falling on photocell 18, causes the conductance of photocell 18 to be high, so that current flows through resistor 58 and photocell 18 to the base of transistor 56. As a result, the resistance between the collector and emitter of transistor 56 is low, so that the end of resistor 70 connected to transistor 56 is in effect connected to ground. Resistor 70 has a much lower value than resistor 68, so that in this condition no current flows into the base of transistor 64, and transistor 64 is held in a non-conducting condition between its emitter and collector.

When the level of ambient light falls to a sufficiently low level, then the resistance of photocell 18 will rise to a sufficiently high value to cut off current to the base of transistor 56. The level of ambient light at which this cut-off occurs is determined by the setting of variable resistor 58, which can be adjusted to provide cut-off of transistor 56 at some desired minimum level of ambient light. In this condition, transistor 56 presents a high resistance between its emitter and collector, so that current flows into the base of transistor 64 from resistors 72 and 70 and also through resistor 68. It should be noted here that resistor 70 is provided as a stabilizing resistor, to prevent the occurrence of spurious oscillation. Due to the feedback between the base and collector of transistor 64 due to primary winding 75 and capacitor 76 and resistor 78, transistor 64 now begins to oscillate. As a result, an alternating voltage of considerably higher peak-to-peak level than the voltage of battery 52 is developed across the secondary winding 77 of transformer 74. This alternating voltage is half-wave rectified by diode 78, and the rectified voltage is smoothed by capacitor 80, which is of relatively high value. This rectified voltage is applied between electrodes 94 and 95 of xenon flash tube 12. Resistor 82 serves to pass a current which charges capacitor 88 to a voltage whose value is determined by the ratio of the values of resistor 82 and variable resistor 84. A portion of the voltage appearing across variable resistor 84 is applied between a slider and a trigger diode 85, known as a DIAC, to the gate terminal of SCR 86. When the voltage thus applied to DIAC 85 reaches a predetermined value, called the breakover voltage, then DIAC 85 goes into a low resistance conducting condition, causing SCR 86 to be triggered. The end of capacitor 88 which is connected to SCR 86 is thereby, in effect, connected to the lower end of step-up coil 90, since the SCR 86 acquires impedance. Capacitor 88 therefore is discharged, causing a current to flow momentarily from SCR 86, through the portion of step-up coil 90 connected between capacitor 88 and SCR 86, back into capacitor 88. This flow of current causes an extremely high voltage to be momentarily generated between the ends of voltage step-up coil 90, resulting in a spark ocurring in xenon flash tube 12. Ionization thereby is produced in xenon flash tube 12, causing the resistance between electrodes 94 and 95 to fall so that the charge on capacitor 80 is discharged between these electrodes. Since capacitor 80 is a high value capacitor, this discharge in xenon tube 12 represents a large amount of energy, so that a high intensity flash of light is produced by xenon flash tube 12 with an extremely short duration.

After discharge has occurred through xenon flash tube 12 as described above, a further discharge will not take place until the breakover voltage of DIAC 85 is again reached. This time depends on the time taken to recharge capacitor 88, i.e. on the values of resistors 82 and 84, and capacitor 88. The time between flashes can be precisely adjusted by varying the position of the slider of variable resistor 84. A clearly audible sound is produced each time xenon flash tube 12 is triggered and a light flash is produced. A blind user is therefore kept informed as to whether the stick has ceased to operate, for example due to battery replacement being required.

In the above embodiment of an electronic circuit module, the use of a cadmium sulphide type of photocell is assumed, however it is equally possible to use various other types of photocells.

It should also be noted that while in the embodiment described above the casing 10 is made of a metallic material such as aluminum alloy, it is also possible to use such material as glass fibre-reinforced plastic for casing 10, in which case all or part of the casing may be made translucent, without using a separate material.

Thus, while the present invention has been shown and described with relation to a particular embodiment, various changes and modifications to this embodiment are possible which come within the scope claimed for the present invention.

What is claimed is:

1. A safety-enhancing walking stick to provide a flashing light warning signal, comprising:

a tubular casing having a least one portion which is translucent;

a light source for providing flashes of light, disposed within said tubular casing adjacent to said portion of said tubular casing which is translucent;

electronic circuit means disposed within said tubular casing, and coupled to said light source for periodically actuating said light source to provide said flashes of light;

a battery disposed within said tubular casing for supplying power to said electronic circuit means;

switch means for selectively connecting said battery to said electronic circuit means; and means for detecting the level of ambient light, said detecting means being coupled to said electronic circuit means for controlling said flashes of light produced by said light source.

2. A safety-enhancing walking stick according to claim 1, wherein said means for detecting the level of ambient light comprises a photocell disposed within said tubular casing.

3. A safety-enhancing walking stick according to claim 1, wherein said tubular casing comprises a translucent material throughout.

4. A safety-enhancing walking stick according to claim 3, wherein said translucent material comprises glass fibre-reinforced plastic.

5. A safety-enhancing walking stick according to claim 1, wherein at least a portion of said tubular casing comprises a metallic material.

6. A safety-enhancing walking stick according to claim 5, wherein said metallic material comprises an aluminum alloy.

7. A safety-enhancing walking stick according to claim 1, wherein said light source comprises a xenon flash tube.

8. A safety-enhancing walking stick according to claim 7, wherein said electronic circuit means comprises a voltage step-up coil connected to electrodes of said xenon flash tube and a silicon controlled rectifier coupled to said voltage step-up coil for triggering said xenon flash tube.

9. A safety-enhancing walking stick according to claim 1, wherein said switch means comprises a knob disposed at one end of said tubular casing, a portion of said knob being contained within said tubular casing and rotatable therein, and wherein contact portions are provided on said portion of said knob contained within said tubular casing for connecting said battery to said electronic circuit means when said knob is rotated into a predetermined position.

10. A safety-enhancing walking stick according to claim 1, wherein said at least one portion of said tubular casing which is translucent is tinted in a suitable color.

11. A safety-enhancing walking stick to provide a flashing light warning signal, comprising:

a tubular casing having at least one portion which is translucent;

a light source for providing flashes of light, disposed within said tubular casing adjacent to said portion of said tubular casing which is translucent;

electronic circuit means disposed within said tubular casing, and coupled to said light source for periodically actuating said light source to provide said flashes of light; and a battery disposed within said tubular casing for supplying power to said electronic circuit means;

said light source comprising a xenon flash tube, and said electronic circuit means comprising a voltage step-up coil connected to electrodes of said xenon flash tube and a silicon controlled rectifier coupled to said voltage step-up coil for triggering said xenon flash tube.

* * * * *